US009211939B2

(12) United States Patent
Torres et al.

(10) Patent No.: US 9,211,939 B2
(45) Date of Patent: Dec. 15, 2015

(54) ANCHOR FOR BOATS

(75) Inventors: Carlos A. Torres, Montgomery, TX (US); Rainer Kuenzel, Hunt, TX (US)

(73) Assignee: Carlos Torres, Montgomery, TX (US)

( * ) Notice: Subject to any disclaimer, the term of this patent is extended or adjusted under 35 U.S.C. 154(b) by 156 days.

(21) Appl. No.: 13/982,102

(22) PCT Filed: Feb. 6, 2012

(86) PCT No.: PCT/US2012/023942

§ 371 (c)(1), (2), (4) Date: Sep. 19, 2013

(87) PCT Pub. No.: WO2012/106704

PCT Pub. Date: Aug. 9, 2012

(65) Prior Publication Data

US 2014/0000503 A1 Jan. 2, 2014

Related U.S. Application Data

(60) Provisional application No. 61/439,842, filed on Feb. 5, 2011.

(51) Int. Cl.

| | |
|---|---|
| ***B63B 21/00*** | (2006.01) |
| ***B63B 21/24*** | (2006.01) |
| ***B63B 21/22*** | (2006.01) |
| *B63B 21/26* | (2006.01) |

(52) U.S. Cl.

CPC ..... *B63B 21/24* (2013.01); *B63B 21/22* (2013.01); *B63B 21/26* (2013.01); *B63B 2021/001* (2013.01)

(58) Field of Classification Search

USPC ..... 114/210, 230.1

IPC ..... B63B 21/00,21/22, 21/24

See application file for complete search history.

(56) References Cited

U.S. PATENT DOCUMENTS

| | | | | |
|---|---|---|---|---|
| 3,272,478 | A | 9/1966 | Binns | |
| 4,334,670 | A | 6/1982 | Kawabe | |
| 4,488,014 | A * | 12/1984 | Daniel et al. | 191/12.2 R |
| 5,890,451 | A | 4/1999 | Bruce | |
| 6,109,197 | A | 8/2000 | Breivik | |
| 7,789,033 | B2 | 9/2010 | Doig | |
| 7,870,829 | B1 | 1/2011 | Perry | |
| 2010/0206212 | A1 | 8/2010 | Lazarevic | |

* cited by examiner

*Primary Examiner* — Stephen Avila

(74) *Attorney, Agent, or Firm* — Bushman Werner, P.C.

(57) ABSTRACT

An elongate anchor arm is rotatably secured to the side of a boat so that the arm may be rotated down from the floating boat and locked into engagement with the water bottom. An anchoring and/or orienting effect is achieved by rotating and locking the arm such that a portion of the side of the arm is forced into and held against the water bottom. For anchoring in water deeper than the length of the anchor arm, one end of a flexible anchor line is secured to a conventional line-deployed anchor and the other line end is attached to the far end of the anchor arm. The arm is rotated to achieve the anchoring and/or orienting effect of attaching the anchor line at different points on the boat.

34 Claims, 7 Drawing Sheets

ANCHOR FOR BOATS

CROSS REFERENCE TO RELATED APPLICATION

This application is U.S. National of international application PCT/US2012/023942, filed on Feb. 6, 2012, which claims priority to U.S. Provisional No. 61/439,842 filed on Feb. 5, 2011, the disclosures of which are incorporated herein by reference for all purposes.

FIELD OF THE INVENTION

The present invention relates generally to anchors used to control the position and/or orientation and/or movement of a boat floating on a body of water.

SETTING OF THE PRIOR ART

It is well understood that the movement, orientation and position assumed by a floating boat typically depend upon the combined effects of forces exerted on the boat by onboard devices and external forces such as wind, wave, and current. The forces producing a particular speed of movement, positioning and orientation also include those exerted through the anchoring mechanism.

Anchor effects on the boat position and orientation are dependent in large part on the type of anchor and the location and manner of attaching the anchor device to the boat.

In many boating situations, the position, speed and orientation of the boat play an important part in facilitating the activity of the boater. For example, sport fishermen usually desire an orientation and positioning of the boat that will permit them to cast their lure in the general direction of a desired fishing area. In some applications, particularly those involving small recreational boats, it is desirable to anchor the boat temporarily while the boater engages in various fishing activities such as baiting a hook or fishing a specific spot. It can also be desired to use the anchor to control the speed and direction of movement of the boat.

A conventional anchor and flexible anchor line can be difficult and awkward to employ, particularly when attempted from very small boats such as canoes or kayaks. Access to the anchor and line may be difficult. Tangling and hanging up of the anchor line and anchor occur easily. Access to a stowed anchor in preparation to anchoring and stowage of a retrieved anchor, sometimes covered with mud or other debris, can also be problematic. Many of these conventional line-attached anchoring techniques are slow, cumbersome, messy and noisy and can disturb the recreational environment.

When the boat is to be anchored in shallow water, typically 8 feet or less in-depth, push poles or rods or other stake-type anchors may be used to assist in positioning and orienting the boat. Stake-type anchors may be pushed into the water bottom either manually or with the assistance of a powering mechanism. These stake-type anchors can be tethered to the boat by a flexible line or may be attached directly to the boat through some suitable mechanical device.

One popular stake-type device used to secure a small boat in shallow water is a slender pole or rod. One end of the stake is manually stabbed into and lodged in the water bottom leaving the other end of the stake extending above the water surface. The stake is often tethered to the boat with a flexible line. Depending on the length of the stake and the depth of the water, such stakes, when deployed as anchors, may extend as much as five feet or more above the water surface.

Another prior art shallow water anchor extends a pole stake through a sleeve carried by a mount secured to the boat. The boater pushes the tip of the stake through the sleeve and into the water bottom to hold the boat in place. One form of the device allows the sleeve of the mount to be pivoted back while the stake remains in the sleeve so that the stake may be stowed horizontally on top of the boat until ready to be used as an anchor.

The shortcomings of long stake-type anchors are particularly evident when the vessel is very small, such as a kayak or canoe and normal operation of the anchor requires the operator to stand, or to use both hands, or to move about the boat to deploy, retrieve, store or otherwise manipulate the anchor mechanism.

One prior art anchor design used for small boats employs a vertically oriented metal stake that is remotely lowered to the water bottom through a sleeve mounted near the bow or stern of the boat. An advantage of the system is that the stake may be raised and lowered with a pulley and line arrangement that may be remotely operated by a seated boat passenger. This type anchor system must be equipped with two such anchors to assists in preventing the boat from changing its orientation. The system operates best in relatively shallow water. However, like most stake anchors, unless anchored in water approximately the same depth as the length of the stake, the stake may project high above the water surface and interfere with normal fishing activity. When the anchor is not in use, such as when the boater is paddling or drifting, the stake extends above the surface of the water for substantially its full length.

Another prior art design uses a heavy steel rod secured at one end to a long flexible anchor line that is tied off to the boat. The rod is thrown into the water like a spear and the tip of the rod stabs into the water bottom to anchor the boat. Changing the anchor attachment point of the line to the boat requires boater movement on the boat or some mechanism that can be operated by the seated boater.

Many of the prior art anchoring devices achieve anchoring by relying on forces that are primarily a result of their weight or of the force applied to penetrate the water bottom with the tip of a stake or an anchor tine. Some, relatively light-weight line-deployed anchors have tines or contours that dig into the water bottom as the anchor is moved along by the force applied through the anchor line. Anchors of this latter type usually require deployment of long anchor lines to enable the anchor to grab the water bottom.

In some locations, penetration of the bottom by the tip of a stake type anchoring device or an anchor tine may be extremely difficult if not impossible. Very hard-packed sandy bottoms, oyster reefs, stone bottoms, and other very hard bottom surfaces that are not easily penetrated by an stake tip or a conventional anchor tine can defeat the anchoring function of some of these prior art devices. Successful anchoring in such locations may often be limited to the use of a weighted anchor that relies primarily on its mass to hold the boat in the desired orientation and location.

While a simple weighted object at the end of a flexible line can effectively anchor a small boat to a hard bottom in relatively calm conditions, such an anchor is subject to being dragged along the water bottom when the boat is under the influence of strong wind or current. Additionally, an anchor having the weight necessary for holding the boat securely on a hard bottom in high wind or fast current may be difficult for the boater to handle and can undesirably contribute to the overall weight of the unanchored boat. These are particularly important considerations when selecting an anchor for a kayak or canoe or other very small vessel.

Problems associated with use of any of the prior art forms of anchor that require the user to shift weight or change position on the boat make them difficult to employ in very small boats where such movements are restricted and could easily tip the boat. Anchors that must be secured to the boat at the bow or stern require difficult, perhaps dangerous, movement of the boat occupant to reach a position where such anchors may be properly tied off, deployed or retrieved. Those anchors that require the use of both hands for gathering up or deploying anchoring gear can force an undesired suspension of a boater's fishing activity. Because of these limitations imposed by small boats, it is frequently necessary to anchor the boat by tying off an anchor line at a point adjacent the seated boater. Tying the anchor line mid-boat, however, can dangerously orient the boat broad side to the wind, waves or current.

To address these problems, the prior art has devised various arrangements for allowing the seated boater to change the effective attachment point of the anchor line to the boat. One of the more common techniques employs a cable and pulley arrangement mounted along the side of the boat. An attachment ring carried by the cable is attached to the anchor line of a conventional line-attached anchor or tied directly to the top of a set stake-type anchor. The seated boat operator pulls the cable through the pulley arrangement causing the attachment ring to be moved fore or aft along the boat so that the effective anchor line connection to the boat can be adjusted as necessary to obtain the desired positioning and/or orientation of the boat.

SUMMARY OF THE INVENTION

A preferred form of the apparatus of the present invention for shallow water anchoring comprises a linearly extending anchor arm having one of its ends connected to a rotatable boat mount whereby a rotary torque force applied from the boat rotates the arm relative to the boat and engages a lower side portion of the arm with the water bottom to effect an anchoring connection between the boat and the water bottom. A mechanical lock holds the arm in the rotated position to maintain the torque in the anchor arm and fix the position and/or orientation of the boat on the water surface. The anchor is released by releasing the lock and rotating the anchor arm to a position where the torque is reduced or entirely relieved.

In the anchored configuration, the length of the arm that extends between the mount and the water bottom remains fixed even as the boat rises and falls in waves and swells. Flexibility in the arm cooperates with the torque force imposed in the arm to maintain anchoring contact between the water bottom and the boat as the boat moves.

In shallow water applications, the anchor of the present invention has novel orienting features that are independent of the anchoring feature. The orienting feature of the described single anchor embodiment of the present invention relies to a degree in securing the arm to the boat so that the arm cannot rotate about its long axis relative to the boat. Preventing such rotation ensures that the torque generated in the set anchor arm will be exerted against the boat to assist in maintaining the orientation of the boat existing when the anchor is first set.

In one form of the anchor of the present invention, the anchor arm is affixed to the rotor of the mount in a manner to prevent rotation and linear movement about and along the linear axis of the arm relative to the rotor. With the arm thus fixed against axial rotation and linear displacement within the rotor, the rotor and affixed arm may be rotated relative to the boat to force the arm against the water bottom. The arm is deformed under the influence of the anchoring force such that the free end of the anchor arm is movable relative to the boat so that the distance between the boat and the free end can be changed without changing the length of the arm extending from the mount.

With the arm locked against rotation in the mount, movement of the free arm end toward the boat produces a resilient biasing force in the arm that tries to restore the separation between the boat and the free anchor end. The result is that the boat anchor provides a shock absorber and remains in contact with the water bottom to maintain anchoring even as the water surface movement raises and lowers the boat and/or current or wind attempt to move the boat. The contact area of the lower portion of the anchor rod with the water bottom resists twisting induced in the rod caused by movement of the boat to assist in maintaining the boat orientation in a line parallel with the line of contact of the rod with the water bottom.

A preferred form of the arm is an elongate, cylindrical resilient rod structure that can be bent along its length to produce a resilient force in the rod tending to resist rotation and to straighten the rod and restore the separation between the two rod ends. A preferred example of such a structure is an elongate rod comprised of fiberglass, spring steel or other suitable material.

The arm may also be a composite device made up of individual segments or components joined together in a manner such that the distance between the mounting end and the free end may be changed by forcing the ends toward each other to produce a resilient force in the arm that tends to restore the separation between the two ends. The arm may also be an elongate rigid member with the resilient force in the arm being provided by a spring or other force storage device or system.

In a method of the invention, the rotational position of an anchor rod is adjusted to emulate the effect of securing the anchor device to different locations or points on the boat. In shallow water, the effect may be obtained by deploying the anchor rod forwardly or aft of its mounting point such that the anchor rod engages the water bottom at different locations relative to the boat. The effective attachment point of the anchor may also be changed by changing the degree of bend in the anchor rod between the boat and the water bottom.

Another embodiment and method of the invention is used to emulate the effect of changing the location of the attachment point of a flexible anchor line to the boat to assist in positioning and orienting the boat in deeper water. This embodiment secures one end of an anchor arm to the boat with a rotatable mount such that the anchor arm can be rotated relative to the boat. The opposite end of the anchor arm is secured to an anchor line that connects to an anchoring device that may be rested on or anchored to the bottom of the water body. With the anchor secured to the bottom, the anchor arm is rotated about the mount to achieve the orienting and positioning effect of tying the anchor line to different points forward and aft of the center of the boat. The anchor arm may be rigid, however the arm is preferably resilient to provide shock absorption between the boat and the anchor and to improve the arm's use as a bottom engaging anchor in shallow water.

A feature of the shallow water anchor embodiment of the present invention is that a single elongate anchor arm may be used to anchor and/or orient the boat in water that is only a few inches deep or water that is several feet deep or almost as deep as the length of the anchor arm. This advantage is obtained without a lengthy part of the arm extending above the water surface.

Because the force of the anchor engagement against the bottom is applied by exerting torque from the rotary mount secured to the boat, the need for a heavy anchor is eliminated, making the entire anchor system significantly lighter than that required when using weighted objects as anchors. This is particularly important in light weight watercraft such as canoes and kayaks.

The pivotal mount of the present invention secures the anchor arm to the boat such that, when not in use, the arm may rest in a substantially horizontal orientation out of the water and alongside or atop the boat. Under normal conditions, the anchor would be stowed in such a position while the boater is paddling the boat or drifting. The anchor remains connected with the boat at a location where it may be operated with one hand of the seated boater so that deployment, retrieval and stowage of the anchor is silent, quick and easy. Using only one hand for anchoring duties eliminates the need to lay down a fishing rod or paddle or change position on the boat.

Still another feature of the anchor of the present invention resides in its ability to direct the anchor arm either fore or aft of the midpoint of the boat. The anchor rod may be set forwardly or rearwardly of the boater as required to best achieve a desired position and orientation.

By adjusting the setting torque of an aft set anchor in a moving boat, the anchor can also act to stabilize and help control the speed and direction of the boat movement.

In one method of the present invention, a boat is anchored to a water bottom with an elongate, flexible rod wherein said rod is forced against the water bottom by force exerted from the boat whereby a major portion of the anchoring forces are exerted against the surface of said water bottom along a length of the side of the arm and in a direction perpendicular to the surface of the water bottom.

In another method of anchoring a boat to a water bottom with an elongate, flexible rod having a boat attachment and an anchoring end, the rod is bent against the water bottom by force exerted from the boat so that a substantial portion of the rod length engages the water bottom and the remote end length of the rod is disposed at a substantially non-90° orientation to the surface of the water bottom.

If desired, two or more anchors of the present invention may be used on a single boat. The anchor may be used with boats larger than kayaks or canoes by appropriately sizing the anchor dimensions. One or more of the anchors of the present invention may also be used as a powered anchor for larger boats.

The foregoing features and advantages of the present invention, as well as others, will be better understood and more fully appreciated from the following claims as well as the descriptions of certain of the specific embodiments of the present invention.

DESCRIPTION OF THE ILLUSTRATED EMBODIMENTS

Figure 1:
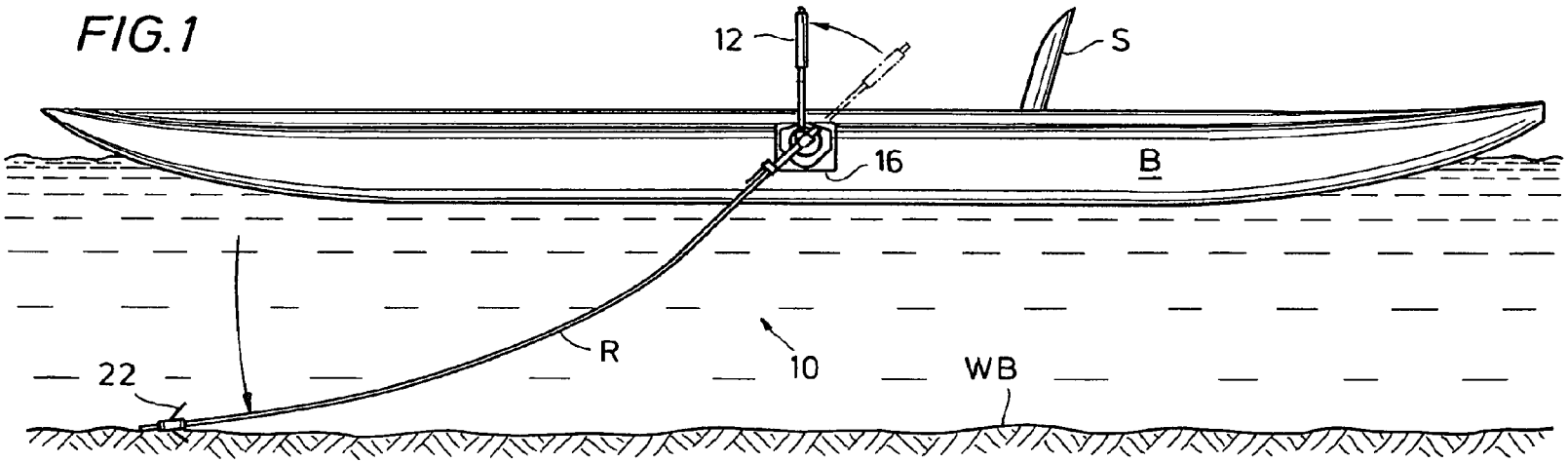
FIGS. 1 and 2 are side elevations of a shallow water form of the anchor of the present invention mounted on a boat anchored against a shallow water bottom.
Figure 2:
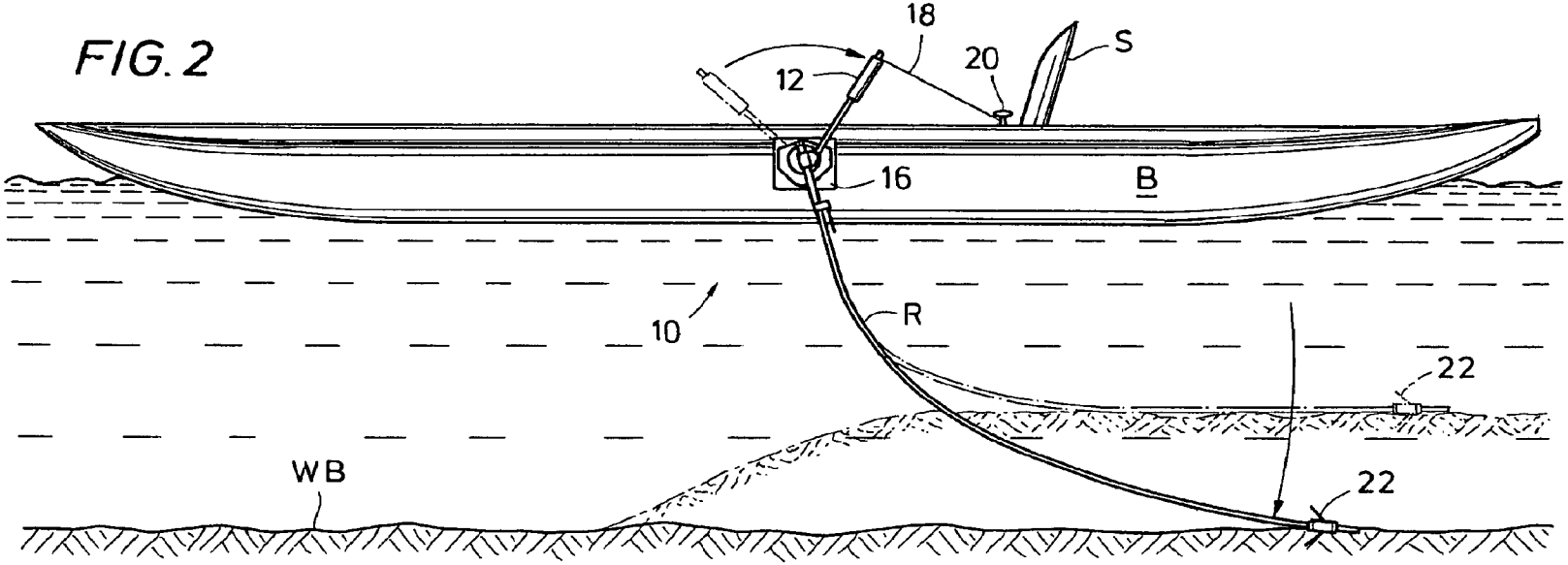

FIGS. 1 and 2 illustrate a side elevation of a small boat B equipped with an anchor of the present invention indicated generally at 10. FIG. 1 illustrates the anchor extended forwardly and FIG. 2 illustrates the anchor extended to the rear of the boat. The anchor is set when a boater (not illustrated) seated in the seat S rotates a handle 12 as indicated by the associated arrows in FIGS. 1 and 2. Rotating handle 12 bends an anchor rod R against the water bottom WB to maintain the boat orientation and hold the boat in place. The anchor rod R is preferably an elongate, cylindrical body comprised of a flexible fiberglass material. A preferred form of the invention employs a 112 inch diameter rod that is approximately 8 feet in length. The rod R and handle 12 are connected through a boat mount 16 that is secured to the side of the boat B. The force of the anchor rod against the water bottom is maintained by locking the handle in its rotated position on the mount. One form of lock is exemplified by a bungee cord 18 illustrated in FIG. 2 holding the anchor handle 12 to boat cleat 20.

When the anchor arm R is fixed against rotation within the mount 16 itself, the set anchor attempts to maintain the boat substantially parallel with the line of engagement of the anchor arm with the water bottom to assist in maintaining the orientation of the boat existing at the time the anchor is set. This orienting effect is greatest in shallow water where the length of the arm lying against the water bottom surface is greatest.

As the boat moves up and down with changing water levels, as indicated with the dotted line variation in FIG. 2, the anchor arm R flexes and the length of the anchor arm lying against the bottom is decreased or increased while maintaining engagement with the water bottom.

A barb or tine 22 may be secured to the free end of the anchor rod for assisting in holding onto the water bottom to prevent dragging of the end of the anchor along the water bottom. The barb 22 may preferentially be removed from the end of the anchor rod when the anchor of the present invention is to be used to assist in controlling the direction and/or speed of movement of the boat. In such cases, the unbarbed anchor rod is deployed rearwardly against the water bottom with torque applied to the anchor arm in an amount sufficient to attain the desired movement of the boat.

Figure 3:
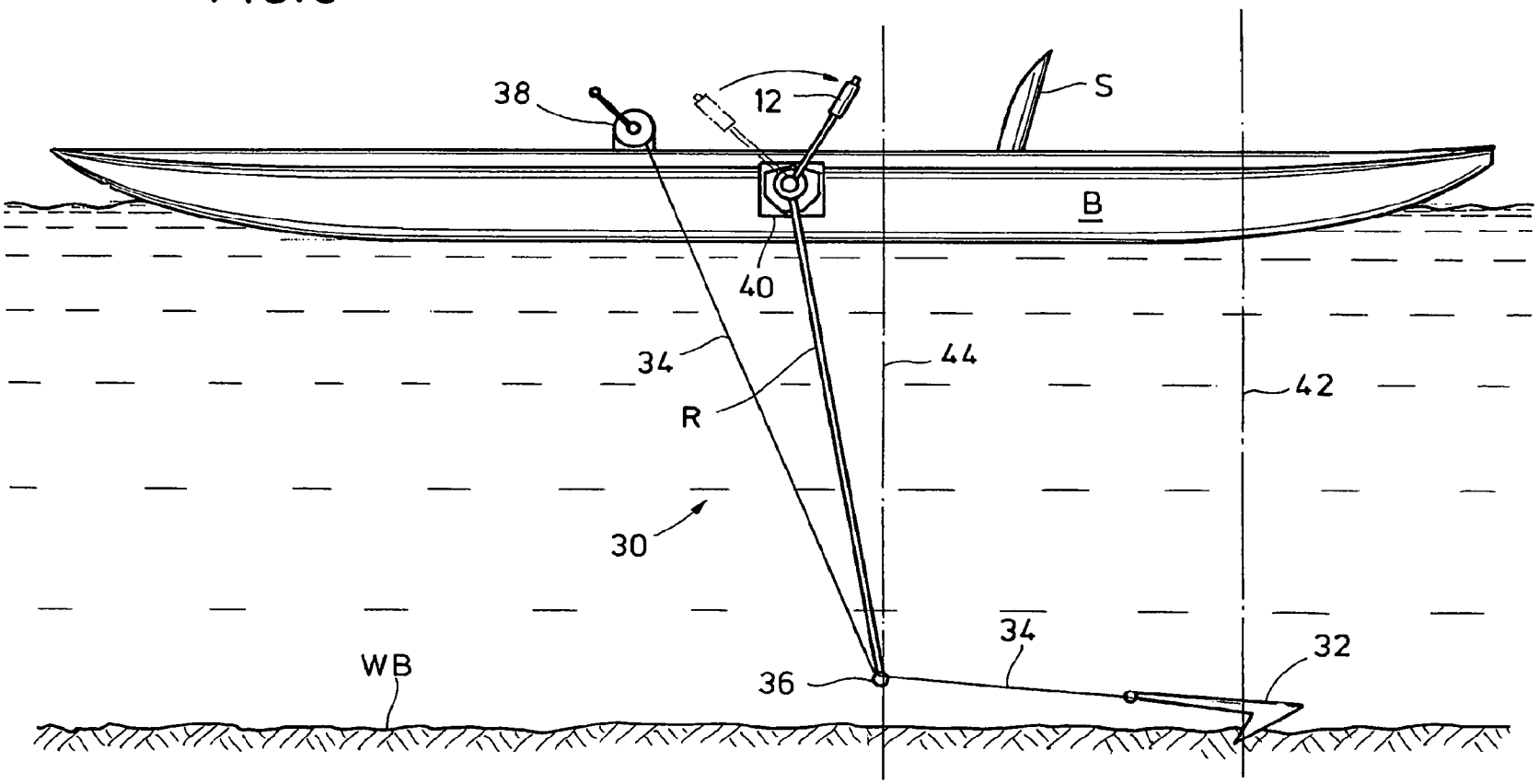
FIG. 3 is a side elevation of a deep water form of the anchor of the present used to anchor a boat to a deep water bottom.

FIG. 3 illustrates details in a deep water configuration of the anchor of the present invention indicated generally at 30. A conventional anchor 32, such as a Danforth anchor or other typical line anchor device, is secured to the end of a line 34, which extends from the anchor through an eye 36 formed at the end of a rod R to a line reel 38 positioned on the boat within reach of a seated boater (not illustrated). A rotatable mount 40 of the present invention is used to rotate the rod R and the eye 36 at the end of the rod as desired to change the apparent location of the attachment of the anchor line 34 to the boat B. FIG. 3 illustrates the anchor line extending rearwardly from the tip of the anchor rod R toward the anchor which is secured to the water bottom WB along the point marked by the vertical line 42. The boat will orient and locate itself as though the anchor were attached to a point rearwardly of the mount 16 even though the physical attachment of the mount is approximately mid-boat.

Anchoring as illustrated in FIG. 3 provides a better angle for engaging the anchor with the bottom and also reduces the radius of rotation of the boat around the set anchor point. Thus, if the boat is affected by a changing wind or current causing it to rotate about the anchor, the boat would move along a circumference having a radius approximately equal to the spacing between the vertical centerline 42 and a vertical line 44 that extends through the attachment point of the eye 36. Rotation about a conventionally set anchor having the line inclination at the point of attachment to the anchor illustrated in FIG. 3 would result in a substantially larger radius of rotation. The net result is that the boat remains closer to a chosen location once this form of the anchor of the present invention has been set.

If the anchor line is let out and an anchor rod R is rotated until it is substantially horizontal and extending to the rear of the boat, the boat will act as though the anchor line is tethered to the boat at its stern. Conversely, if the rod is rotated forwardly up to the bow of the boat, the boat will orient in the wind or current as though the anchor line were tied to the bow of the boat.

Figure 4:
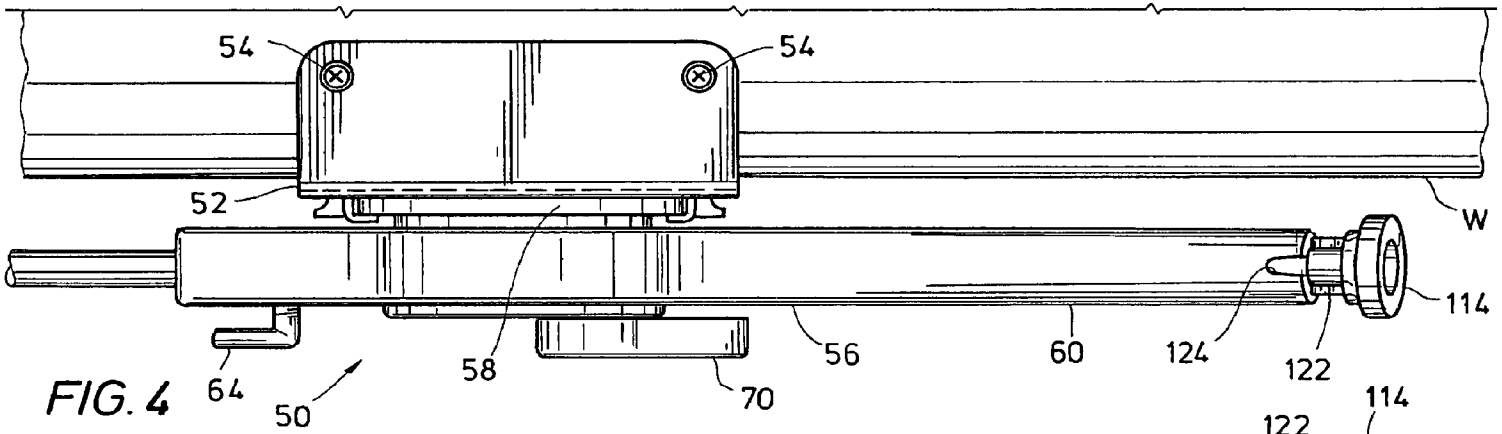
FIG. 4 is a top plan view of a preferred form of the anchor of the present invention secured to a boat.
Figure 5:
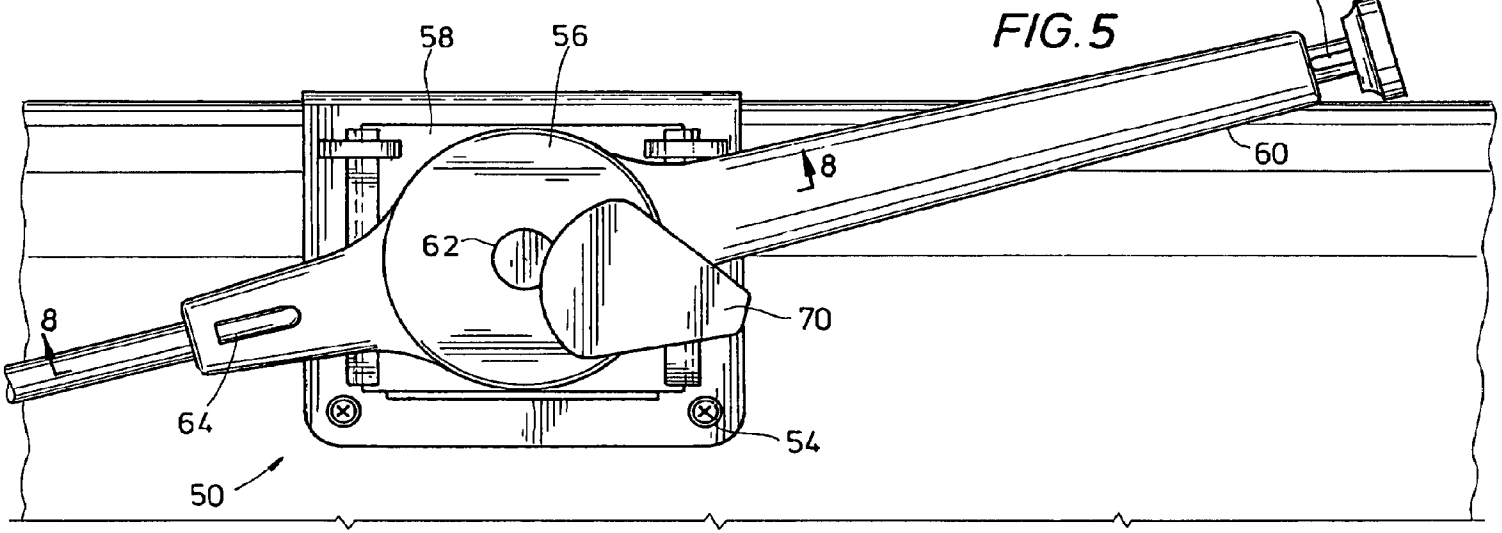
FIG. 5 is a side elevation of the anchor of the present invention.

FIGS. 4 and 5 illustrate one form of the anchor of the present invention indicated generally at 50 secured to the outside wall W of a boat. FIG. 4 illustrates the anchor as viewed looking down from above the gunwale of the boat and FIG. 5 illustrates the anchor as a vertical elevation on the outside of the boat. An L-shaped anchor mount 52 is screwed or bolted or otherwise suitably secured to the wall W of the boat with attachment devices such as screws 54.

The anchor 50 includes a rotor section 56 and a stator section 58. During operation, the stator section 58 is immovably held by the anchor mount 52. The rotor section 56 rotatably attaches to the stator 58 such that the anchor rod R may be rotated to different angular positions by rotating a rotor handle 60. A central holding bolt 62 secures the rotor to the stator. A manually releasable set screw 64 holds the end of the fiberglass rod R within a rod end receiving bore formed in the end of the rotor opposite the handle 60.

The rotor section 56 and stator section 58 are coupled for rotary movement relative to each other with a ratchet mechanism that regulates the permissible direction of rotation of the rotor relative to the stator. The word "ratchet" is used herein in its customary and normal meaning as being a mechanical device that allows continuous linear or rotary motion in only one direction while preventing motion in the opposite direction. The term "reversing means" is used herein to indicate means for reversing the direction of allowed motion.

Figure 6:
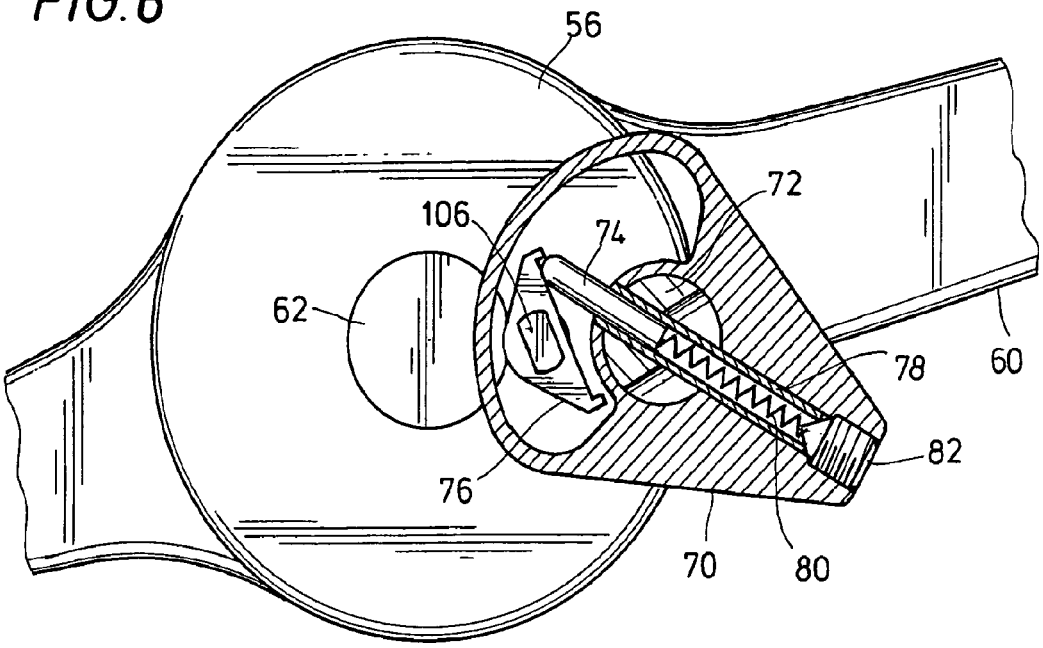
FIG. 6 is a partial view, partially in section, taken along the line 6-6 of FIG. 8, illustrating details in the construction of a ratchet lock reversing mechanism of the present invention.
Figure 7:
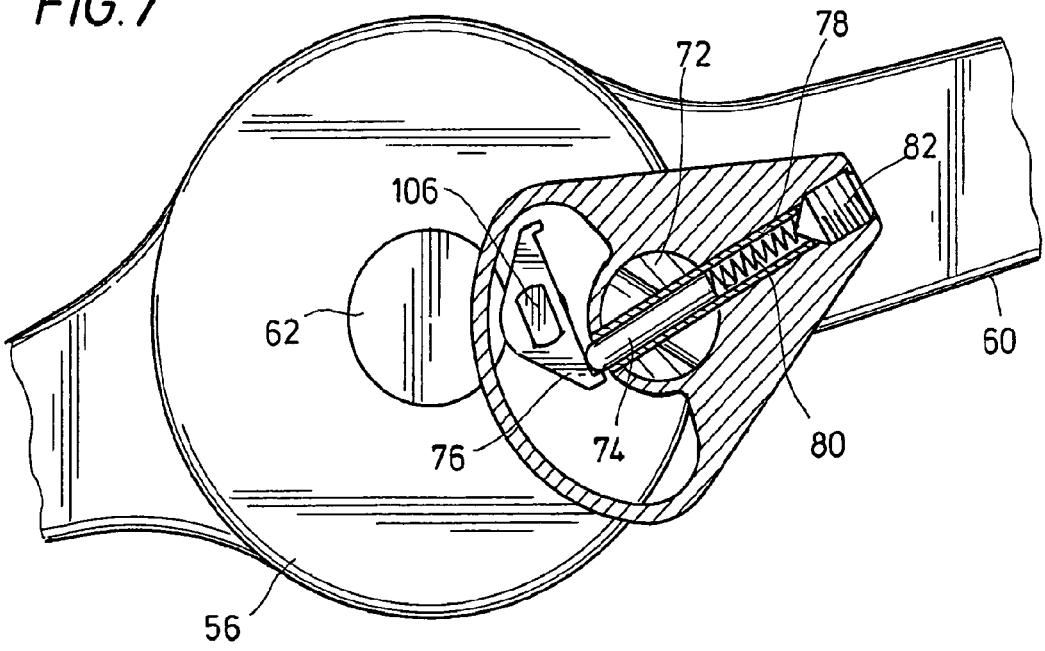
FIG. 7 is a view similar to that of FIG. 6 illustrating the reversing mechanism moved to a position reversing the direction of locking position illustrated in FIG. 6.

The locking direction of the ratchet movement is determined by the position of a lock reverse lever 70 illustrated in FIGS. 6 and 7 in partial sectional view. With the lever 70 in the position illustrated in FIG. 6, the rotor may be rotated relative to the stator in a counterclockwise direction. When the ratchet reverse lever 70 is moved into the position illustrated in FIG. 7, the rotor is prepared for rotation in a clockwise direction. To this end, the reverse lever 70 is mounted on a slotted post 72 integrally formed with the rotor 56. A spring-loaded pin 74 extends diametrically through the slot in the post 72 and engages a pawl drive 76. Rotation of the reverse lever on the post 72 changes the point at which the spring load is applied to the pawl drive. The steel pin 74 is carried within a brass sleeve 78 which also contains a coil steel spring 80. The assembly is retained in place within the bore extending through the reverse lever with a threaded set screw 82. The set screw 82 is also used to adjust the spring force being exerted against the pawl drive.

The lever arm 70 may be constructed of fiber filled nylon, metal or any other suitable materials. The pin 74, pawl drive 76, sleeve 78, spring 80 and set screw 82 may suitably be constructed of metal but may also be constructed of any suitable material, including synthetics. All of the materials used in the anchor are preferably corrosion resistant because of their anticipated usage in corrosive environments.

Figure 8:
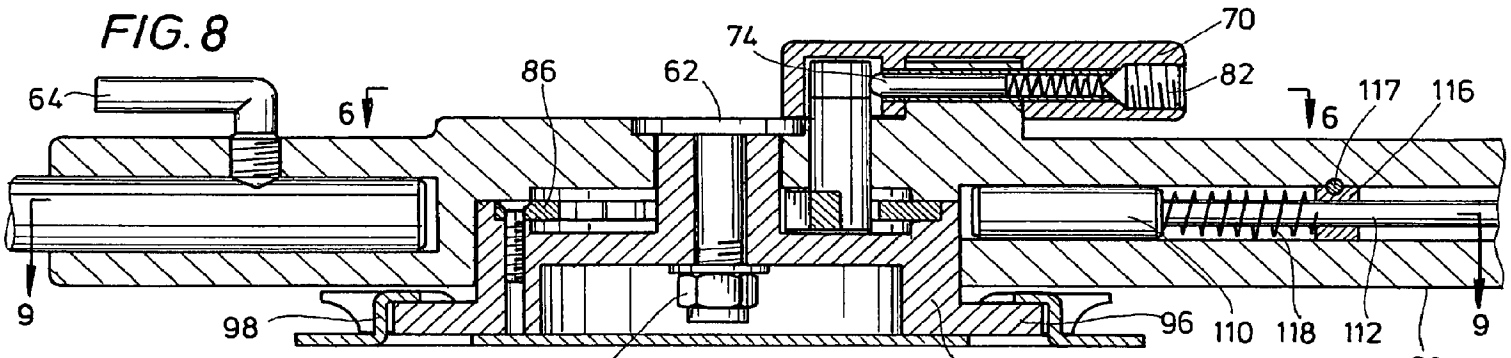
FIG. 8 is a partial sectional view of the anchor of the present invention taken along the line-8-8 of FIG. 5.
Figure 9:
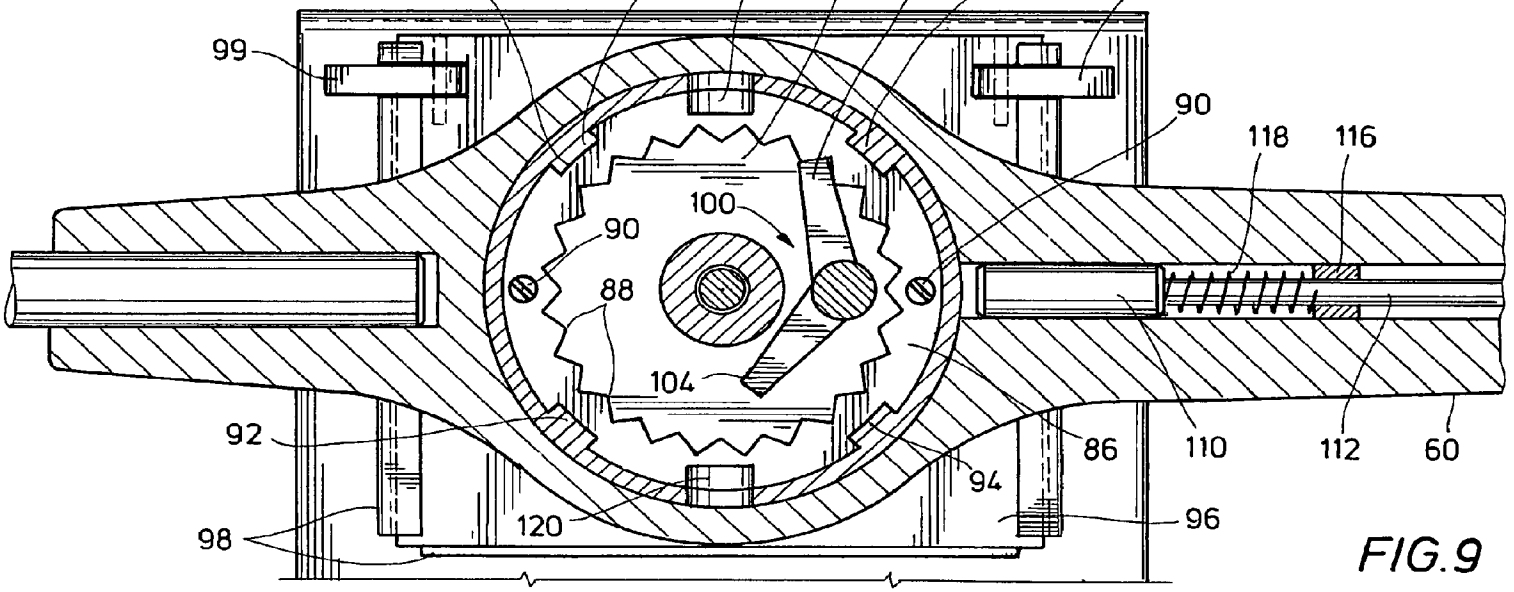
FIG. 9 is a partially cutaway view of the anchor of the present invention taken along line 9-9 of FIG. 8.
Figure 10:
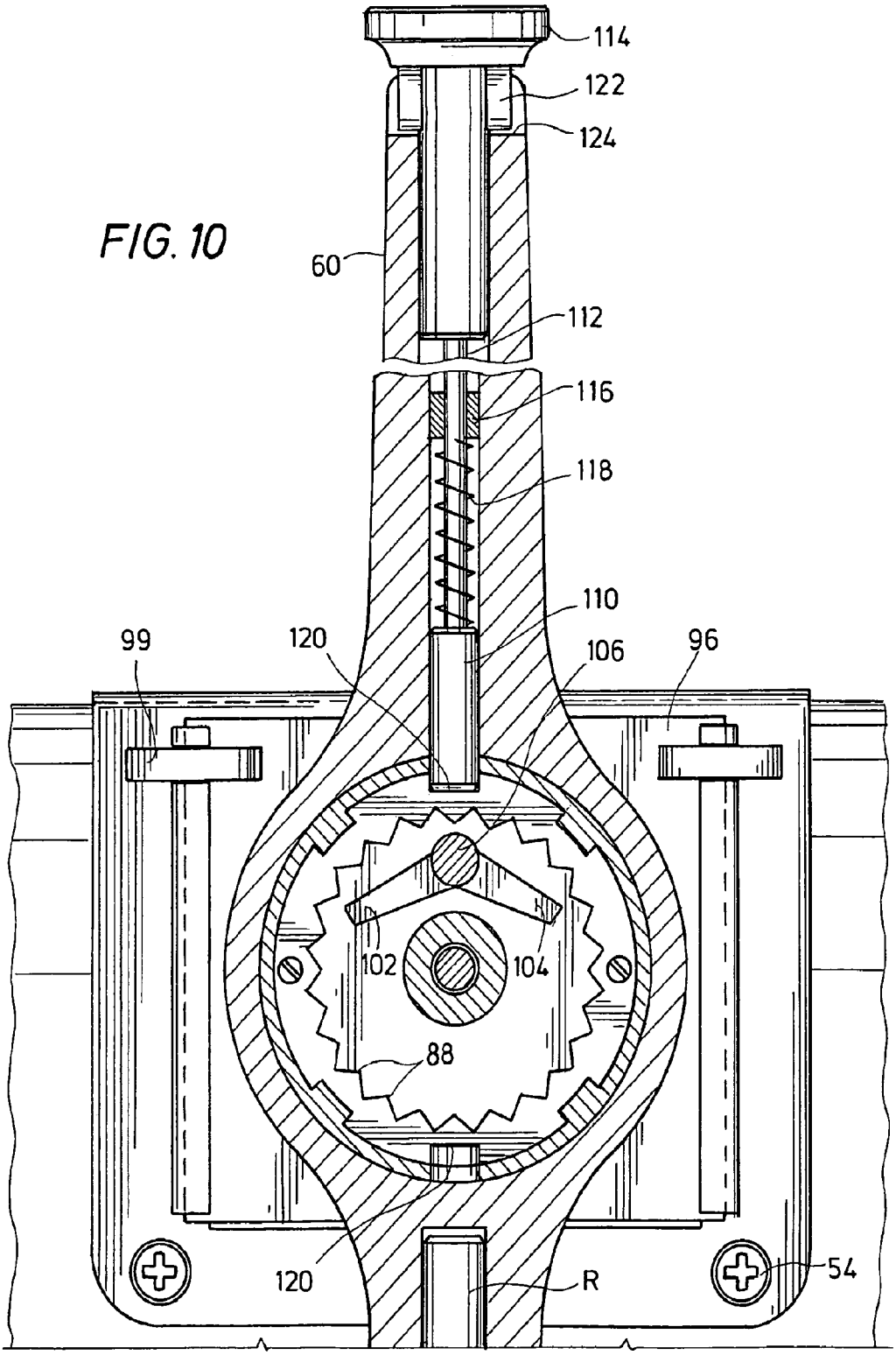
FIG. 10 is a partial sectional view illustrating details in a bidirectional lock of the present invention.

Referring jointly to FIGS. 8-10, the stator includes a circular hub 84 to which is secured a steel ratchet tooth ring 86. Ratchet teeth 88 are formed along an internal circumference of the ring. The steel ring 86 is secured to the stator, which may be formed of fiber filled nylon or other suitable material, with any suitable fastening means such as screws 90. Interconnecting projections 92 from the hub and recesses 94 in the ring assist in preventing rotation of the ring within the stator hub. The circular hub of the stator is preferably formed as one piece with a rectangular mounting section 96 at its base. The mounting section 96 is received within retaining walls 98 extending from the face of the anchor mount 52. Releasable pins 99 are used to hold the stator within the retaining walls 98 of the anchor mount. The stator may be removed from this position within the mount 52 by releasing the pins RP. The anchor mount may be made of any suitable material including aluminum, stainless steel or synthetics.

As best illustrated in FIGS. 8, 9 and 10, a pawl indicated generally at 100 with arms 102 and 104 extending from a center rotating shaft 106 is disposed within the ratchet ring 86 such that the ends of the arms 102 and 104 may selectively engage the teeth 88 of the ratchet ring. The arms 102 and 104 are rotated into and out of engagement with the ratchet teeth by operation of the ratchet reverse lever 70, previously described. Thus, when the ratchet reverse lever is in the position illustrated in FIG. 6, the pawl drive acts through the shaft 106 to hold the pawl arm 104 in engagement with the ratchet teeth. In this position, the rotator may be rotated in a clockwise direction but will stop reverse motion in a counterclockwise direction. When the lever 70 is moved to the position illustrated in FIG. 7, the force of the compressed spring will urge the pawl shaft in a direction that will move the arm 102 into engagement with the ratchet teeth as illustrated in FIG. 9. Once the pawl rotates to this position, the rotor may be turned in a counterclockwise direction but will prevent movement in the clockwise direction.

The head of the holding bolt 62 is notched and the shaft 106 extends through the notch so that the holding bolt 62 is held against rotation when a nut 108 is secured to its threaded end to hold the rotor and stator together.

A bilateral locking feature is provided by a spring-loaded piston 110 carried centrally within the handle 60. The bilateral locking feature is used to lock the anchor against rotation in either the clockwise or counterclockwise rotation at two different rotary positions. A connecting cylindrical link shaft 112 extends between the piston and a deactivating knob 114 (FIG. 10) at the end of the handle. A stop 116 is secured within the bore extending through the handle length with a pin 117 to provide a stationary base for a coil spring 118 that urges the piston 110 toward lock recesses 120 formed in the outer circumference of the stator hub. The connecting link 112 is free to slide through the stop 116.

When the piston 110 indexes with one of the recesses 120 illustrated in FIG. 10, the spring 118 pushes the piston into the recess, which locks the rotor against rotation relative to the stator in both the clockwise and counterclockwise directions. This feature keeps the anchor fixed when the boat moves in a direction that changes the direction of the reaction force acting through the anchor arm. Without this feature, if the direction of applied force on the locked ratchet reverses, the anchor arm may rotate in the non-locking direction of the ratchet, releasing the anchor engagement. Multiple recesses 120 may be provided in the hub of the stator to provide additional bilateral stopping points.

The operation of the bilateral locking feature may be disabled, as illustrated in FIGS. 8 and 9, by pulling the end knob 114 linearly away from the center of the hub and rotating the knob 90° to lock it back in the retracted position. Rotating the knob 114 rotates a narrow projection 122 extending downwardly from the head of the knob to a right angle position relative to a slot 124 formed at the top end of the arm handle 60 where the piston is held away from the stator to permit free rotation.

Figure 11:
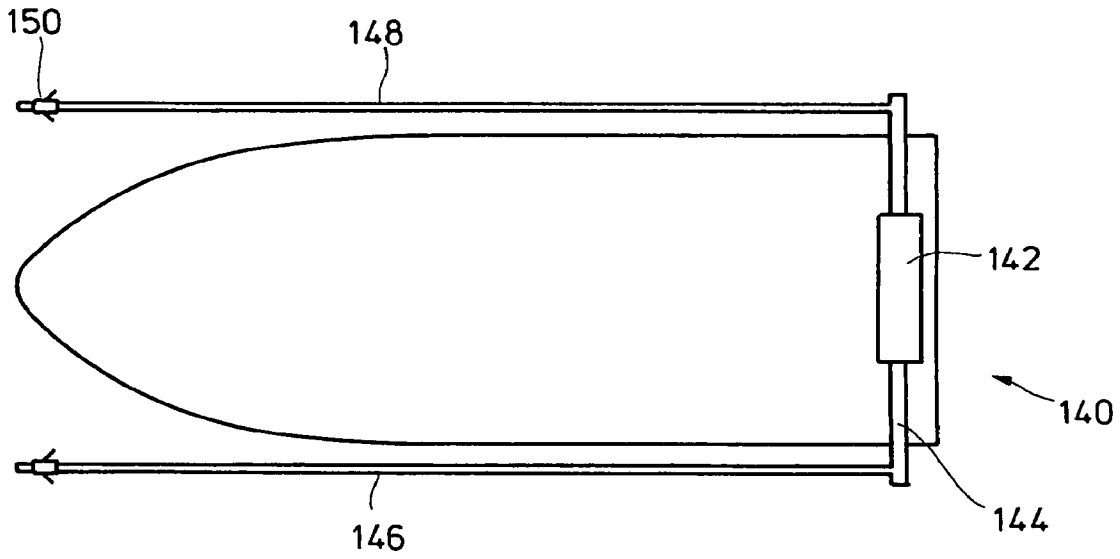
FIG. 11 is an overhead view of a modified form of the present invention employing two anchors of the present invention.

FIG. 11 is an overhead view of a boat equipped with an anchor system of the present invention, indicated generally at 140, employing dual anchor arms. A power rotation drive 142, such as a reversible DC motor assembly, powers a main shaft 144 causing the attached anchor rods 146 and 148 to rotate as desired into or out of anchoring engagement with the water bottom below the boat. If desired, barbs 150 may be attached to the ends of the anchor rods to assist in gripping the water bottom. When deploying the anchors in a forward position, the anchor rods may be set by rotating the rods directly down into the water from the position illustrated in FIG. 11. Rotation is continued after the lower ends of the rods engage the water bottom until sufficient downward force is exerted by the rods against the water bottom to hold the boat in place. Alternatively, if desired, the anchor rods may be rotated 180° from the position illustrated in FIG. 11 to be positioned for anchoring at the rear of the boat. As with the other anchor embodiments of the present invention, the anchor rods assist in securing the boat or regulating its movement over the water by engaging and bearing against the water bottom along a section of their lower length rather than by penetration of the water bottom with the tip of the rods as is normally the case with stake-type anchors. The rods may be brought to an above water position for stowage.

If desired, one or both of the anchor rods may be employed for anchoring and, with suitable modification of the drive system or a second drive system, one anchor may be directed forwardly and the other directed rearwardly for simultaneous deployment into anchoring position as required to attain a desired anchoring configuration. The drive system in the form of the invention illustrated in FIG. 11 may also be provided through some electric-over-hydraulic drive arrangement. The anchors may also be manually operated and locked in position using the teachings of the present invention.

While the foregoing is directed to specific embodiments of the present invention, other and further embodiments of the invention may be devised without departing from the basic spirit and scope of the present invention, which invention is more fully defined by the following claims.

The invention claimed is:

1. A device for assisting in anchoring a floating boat, comprising:

a rotor adapted to be rotatably secured to the boat, an anchor arm operatively connected to the rotor for rotary movement with said rotor, said anchor arm having an arm length extending between a proximal end secured to said rotor and a distal end having water bottom contact means operable through said arm for impeding the movement of a boat when contacting a water bottom, a drive means operatively connected to the rotor for receiving an anchoring drive force to cause relative rotation between the rotor and the boat for contacting said water bottom with said anchor arm without changing the length of said anchor arm between said proximal end where said arm is secured to said rotor and said distal end having said water bottom contact means; and a ratchet lock having a mechanism permitting rotation in one direction and preventing rotation in another direction for limiting the relative rotation between the rotor and the boat at selected different angular positions whereby, when said rotor is secured to the floating boat, rotation of said rotor relative to said boat may move said anchor arm down toward a water bottom below the floating boat.

2. A device as defined in claim 1, wherein said rotor is rotatable sufficiently whereby an anchor arm operatively connected to said rotor may be rotated clockwise or counterclockwise toward a water bottom below a floating boat.

3. A device as defined in claim 1 wherein said drive means comprises a manually engageable handle for manually driving said rotor to different angular positions relative to a boat to which said rotor may be secured.

4. A device as defined in claim 1 wherein said ratchet lock comprises a selectively operable lock assembly for locking said rotor to prevent relative rotation between said rotor and the boat to which said rotor is to be secured.

5. A device as defined in claim 1 further including a rotor engagement means adapted to secure said rotor to an arm securing means.

6. A device as defined in claim 5 wherein said rotor engagement means comprises a manually operable handle that forms a portion of said drive means.

7. A device as defined in claim 6, further comprising an anchor arm release mechanism included in said arm securing means for enabling a manually operable release between said rotor and said anchor arm.

8. A device as defined in claim 1 further including a line receiving fixture secured to said arm for slideably receiving an anchor line adjacent said arm whereby said anchor arm rotation may change the apparent attachment point of an anchor line to a floating boat to which said rotor may be secured.

9. A device as defined in claim 1 wherein said ratchet lock includes a spring biased pawl for engagement with ratchet teeth in said ratchet lock such that said rotor may be released from locking engagement by applying force on said drive means to release the pawl for movement in response to the spring bias.

10. A device as defined in claim 1 wherein said ratchet lock comprises a ratchet assembly having reversing means for reversing the direction of free rotation of the rotor relative to the boat to which the rotor may be secured.

11. A device as defined in claim 1 further including a floating boat mount assembly adapted to be secured to a floating boat, said floating boat mount assembly having means for releasably holding said rotor whereby said rotor may be quickly released from said floating boat mount assembly while said floating boat mount assembly remains secured to said floating boat.

12. A device as defined in claim 1 further including a linearly movable engagement mechanism that can be extended between the rotor and the boat to which it may be secured to lock relative motion between the rotor and the boat to which it may be secured.

13. A device as defined in claim 1 further including a linearly movable engagement mechanism that can be engaged with the rotor to lock relative motion between the rotor and a boat to which it may be secured.

14. An anchor for use on a floating boat comprising an anchor arm having a proximal end for attachment to a floating boat and a distal end for engagement with a water bottom, a flexible body segment included in said anchor arm for permitting said distal end to be flexed toward and away from said proximal end, a rotary mount for securing the anchor arm to a floating boat whereby the anchor arm may be rotated relative to a floating boat to which the mount is secured, and a water bottom engagement structure included with said anchor arm whereby the length and area of engagement of a portion of a side of said anchor arm with a water bottom may be increased as the anchor arm is rotated and flexed against the surface of the water bottom.

15. An anchor for a floating boat as defined in claim 14 further comprising biasing means for exerting a torsional force on said anchor arm for urging said anchor distal end to move in a direction from a floating boat to which it is to be attached toward a water bottom below such floating boat and locking means to maintain a torsional force on said anchor distal end when said anchor distal end is engaged with a water bottom.

16. A method of anchoring a floating boat with an anchor arm having a distal end and a proximal end, said proximal end having a floating boat attachment means for attaching said arm to a floating boat and a distal end for engaging a water bottom below said floating boat, said arm being flexible and resilient along at least a portion of its length between said distal and proximal ends, rotating said arm from said proximal end to engage said distal end with a water bottom, inducing a rotary torque on said arm after said arm engages said water bottom to create forces in said arm normal to said water bottom for securing said distal end to said water bottom, and fixing said arm at a rotary position that maintains said distal end in engagement with said bottom and maintains a rotary torque in said arm as said floating boat moves relative to said bottom.

17. A method as defined in claim 16 above wherein said arm comprises a fiberglass rod.

18. A method as defined in claim 16 wherein said rotary torque is induced to reach an anchor position such that said arm is resiliently forced against said water bottom, laying an elongate portion of said arm adjacent said anchor distal end along the water bottom, and locking said arm at said anchor position to maintain said resilient force whereby movement of said floating boat relative to said water bottom is impeded.

19. A method as defined in claim 18 further comprising pivoting said arm to move said arm to a storage pivotal position at which said arm distal end is above the surface of the water, and locking said arm at said storage pivotal position whereby movement of said boat relative to said water bottom is unimpeded by said arm.

20. An anchor device for assisting in anchoring a boat floating above a water bottom, comprising:

an elongate anchor arm structure extending between first and second ends, a rotor mount adjacent said first anchor arm end for rotary engagement with a boat, water bottom engaging means connecting with said second anchor arm end for engaging a water bottom to impede movement of said boat, a drive means operatively connected to the rotor mount for receiving an anchoring drive force to cause relative rotation between the rotor mount and the boat for contacting said water bottom with said water bottom engaging means, and a ratchet lock having a mechanism permitting rotation in one direction and preventing rotation in another direction for locking said anchor arm at different angular positions relative to said boat.

21. An anchor device as defined in claim 20 wherein said anchor arm is resiliently flexible along at least a portion of its length between said rotor mount and said water bottom engaging means.

22. An anchor device as defined in claim 20 further including a line receiving fixture connected with said anchor arm second end for slidably receiving an anchor line whereby movement of said anchor arm about said rotor mount may change the orientation of said boat relative to the orientation of said anchor line.

23. An anchor device as defined in claim 20 wherein said ratchet lock includes a ratchet tooth member and a pawl member whereby engagement of the pawl member with different teeth in the ratchet tooth member may lock the anchor arm at different angular positions relative to said boat and wherein said ratchet lock includes an adjustable spring member acting on said pawl member for applying a reversible force on said pawl member for urging movement of said pawl member to a position reversing the permitted direction of rotation of said anchor arm.

24. An anchor device as defined in claim 20 wherein said anchor device includes a mount with manually operable means for releasably securing said anchor device to a boat.

25. An anchor device for assisting in anchoring a boat floating above a water bottom, comprising:

an elongate anchor arm structure extending between first and second arm ends, a rotor mount adjacent said first anchor arm end for rotary engagement with a boat, water bottom engaging means connecting with said second arm end for engaging a water bottom to impede movement of said boat, locking means for locking said anchor arm at different angular positions relative to said boat, and a power drive connecting with said rotor mount whereby powered movement of said drive may force an elongate portion of said anchor arm structure adjacent said second end to lay along and bear against the surface of a water bottom to impede movement of said boat.

26. An anchor device as defined in claim 25 further including a single power drive and dual anchor arms.

27. An anchor device as defined in claim 25 wherein said elongate anchor arm structure includes an elongate, resilient flexible rod extending from said rotor mount, said power drive connects with said rotor mount whereby movement of said drive may move an elongate portion of said rod adjacent said second end to lay along and bear against the surface of a water bottom, and said power drive may rotate said anchor arm through 360° of movement.

28. An anchor device as defined in claim 20 wherein said elongate anchor arm may be rotated through 360° either clockwise or counterclockwise.

29. An anchor device as defined in claim 20 wherein said anchor arm includes an elongate, resilient flexible rod extending from said rotor mount and a drive connecting with said rotor mount whereby movement of said drive may move an elongate portion of said rod adjacent said second end to lay along and bear against the surface of a water bottom.

30. An anchor device as defined in claim 29 further including a power drive for moving said anchor arm.

31. An anchor device as defined in claim 20 wherein, said locking means includes a ratchet tooth member and a pawl member whereby engagement of the pawl member with different teeth in the ratchet tooth member may lock the anchor arm at different angular positions relative to a boat, said locking means includes a spring member connected with said pawl member for determining the permitted direction of rotation of said anchor arm, said anchor arm may be rotated and locked through 360° either clockwise or counterclockwise, and a water bottom holding means is secured to said anchor arm adjacent said second anchor arm end.

32. An anchor device as defined in claim 31 wherein said rotor mount includes an L-shaped member for securing engagement with said boat.

33. An anchor device as defined in claim 32 wherein said rotor mount is adapted to be threadably engageable and releasable from said boat.

34. An anchor device as defined in claim 20 wherein said rotor mount includes an L-shaped member for securing engagement with said boat.

* * * * *